United States Patent [19]

Theurer et al.

[11] Patent Number: 4,534,415

[45] Date of Patent: Aug. 13, 1985

[54] BALLAST CLEANING MACHINE WITH TWO BALLAST SCREENING INSTALLATIONS

[75] Inventors: Josef Theurer, Vienna; Manfred Brunninger, Linz, both of Austria

[73] Assignee: Franz Plasser Bahnbaumaschinen Industriegesellschaft m.b.H., Vienna, Austria

[21] Appl. No.: 506,297

[22] Filed: Jun. 21, 1983

[30] Foreign Application Priority Data

Sep. 20, 1982 [AT] Austria ..... 3503/82

[51] Int. Cl.[3] ..... E01B 27/00

[52] U.S. Cl. ..... 171/16

[58] Field of Search ..... 171/16; 172/33; 198/358; 37/239, 104; 104/2, 7 R

[56] References Cited

U.S. PATENT DOCUMENTS

| | | | |
|---|---|---|---|
| 2,142,208 | 1/1939 | Protzeller | 171/16 X |
| 2,787,389 | 4/1957 | Walters | 171/16 UX |
| 3,957,000 | 5/1976 | Plasser et al. | 104/2 X |
| 4,014,389 | 3/1977 | Theurer et al. | 171/16 |
| 4,043,398 | 8/1977 | Folser et al. | 171/16 |
| 4,245,703 | 1/1981 | Theurer et al. | 171/16 |

FOREIGN PATENT DOCUMENTS

| | | |
|---|---|---|
| 970010 | 9/1964 | United Kingdom . |
| 2080858 | 2/1982 | United Kingdom . |

*Primary Examiner*—Richard T. Stouffer
*Attorney, Agent, or Firm*—Kurt Kelman

[57] ABSTRACT

In a mobile ballast cleaning machine comprising a frame, an arrangement for excavating the ballast and for conveying the excavated ballast, a first vibratory and vertically adjustable ballast screening installation mounted on the frame and having an inlet to receive the conveyed ballast from an output of the ballast excavating and conveying arrangement and to separate the ballast into a cleaned ballast component and a waste component, and conveyors for redistributing the cleaned ballast component and for removing the waste component: a further ballast screening installation mounted on the frame, separate drives for vibrating and for vertically adjusting the further ballast screening installation, and a remote-controllable conveyor arranged selectively to receive the ballast from the ballast excavating and conveying arrangement output and to deliver it to an inlet of the further ballast screening installation.

9 Claims, 4 Drawing Figures

BALLAST CLEANING MACHINE WITH TWO BALLAST SCREENING INSTALLATIONS

The present invention relates to a mobile ballast cleaning machine comprising a frame, undercarriages supporting the frame for mobility on a track resting on the ballast, an arrangement for excavating the ballast and for conveying the excavated ballast, the ballast excavating and conveying arrangement being vertically adjustably mounted on the frame and including a driven endless chain for excavating and conveying the ballast and a polygonal guide for guiding the driven chain, the guide having a transverse section and at least one section leading from the transverse section in a longitudinal direction along the frame, a vibratory and vertically adjustable ballast screening installation mounted on the frame and having an inlet to receive the conveyed ballast from an output of the ballast excavating and conveying arrangement and to separate the ballast into a cleaned ballast component and a waste component, and conveyor means for redistributing the cleaned ballast component and for removing the waste component.

Such mobile ballast cleaning machines are known, for example, from U.S. Pat. No. 4,014,389, dated Mar. 29, 1977, and have been commercially successful. However, when the excavated ballast is very dirty, the waste component is so large that satisfactory cleaning of the ballast can be effected only with an excavating and conveying chain operating at reduced speed and a correspondingly slower advance of the machine along the track. The same holds true for deeper ballast beds. In the patented ballast cleaning machine, the transverse guide linkage section, which passes below the track through the ballast and, in switches, below the two tracks of the switch, consists of a plurality of detachable guide linkage members to enable the length of the transverse guide linkage section to be adjusted. The ballast screening installation, which comprises a plurality of superposed screens, may be vibrated to impart linear oscillations thereto and is mounted on shock absorbers to dampen the vibrations. In superelevations, it may be vertically adjusted by a hydraulic drive to be pivoted about a horizontal axis extending in the direction of elongation of the machine frame to assume a more or less horizontal position. The conveyor means for redistributing the cleaned ballast component and for removing the waste component may include a combination of pivotal and/or vertically adjustable conveyor bands which may be driven in opposite directions.

U.S. Pat. No. 4,043,398, dated Aug. 23, 1977, discloses such a ballast cleaning machine adapted for the rehabilitation of the sub-grade of a track bed, wherein the excavating and conveying arrangement is arranged to excavate the sand and ballast layers on the sub-grade, to separate the sand and ballast components, and to redistribute the separated components to lay a sand layer on the sub-grade and then to superimpose a ballast layer thereover. This otherwise commercially successful machine also suffers, however, from the above-indicated relative slowness.

In the similar ballast cleaning machine of British Patent Specification No. 2,080,858 A, a reference systeam is provided to control the excavating depth, the depth of the ballast bed, any superelevation and any desired difference in the ballast bed level before and after cleaning. This control system comprises interconnected hydrostatic level measuring instruments mounted in the range of the undercarriages and at the ballast excavating and conveying arrangement and the electrical control signals derived from these instruments are transmitted to a central measuring, recording and indicating apparatus. Such a ballast cleaning machine is very useful in providing a good track bed of a uniform depth.

It is the primary object of this invention to provide a ballast cleaning machine of the first-described type with a substantially increased cleaning capacity.

The above and other objects are accomplished according to the invention with a further ballast screening installation mounted on the frame, separate drive means for vibrating and for vertically adjusting the further ballast screening installation, and a remote-controllable conveyor means arranged selectively to receive the ballast from the ballast excavating and conveying arrangement output and to deliver it to an inlet of the further ballast screening installation.

This structure assures a relatively high screening capacity even in track section where the ballast is very dirty and/or where the ballast bed is rather deep so that it has become possible for the first time to use the full conveying capacity of the excavating chain in such difficult track sections, too, and to operate the machine in such sections at the same forward speed as in other track sections. This combination makes it possible, therefore, to retain the full operating speed of the ballast cleaning machine at a uniformly high cleaning quality regardless of the differences in the amount of dirt in the ballast or the amount of ballast to be cleaned.

The above and other objects, advantages and features of the present invention will become more apparent from the following detailed description of certain now preferred embodiments of this invention, taken in conjunction with the accompanying somewhat schematic drawing wherein FIG. 1 is a side elevational view of a ballast cleaning machine according to one embodiment of the invention;

Figure 1:
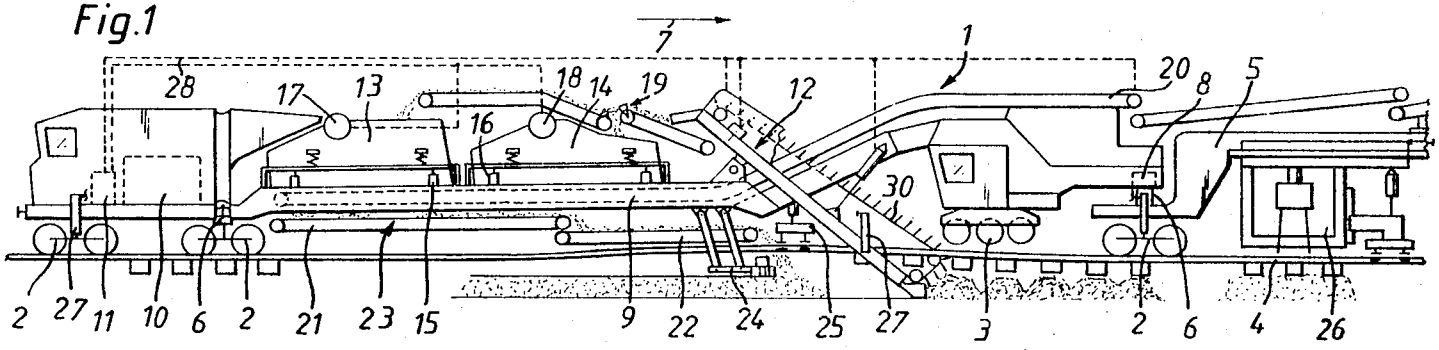

Referring now to the drawing and first to FIG. 1, mobile ballast cleaning machine 1 comprises frame 9 having pivotally supported ends 6 and undercarriages 2, 3 supporting the frame for mobility on track 4 resting on the ballast in an operating direction indicated by arrow 7. Drive 8 enables frame end 6 adjacent ballast excavating and conveying arrangement 12 to be vertically adjusted. This swivel arrangement makes the relatively long frame stable enough to use high speeds when the machine is transferred between operating sites. The vertical adjustability of the one frame end makes it possible simply to adjust the wheel base of the machine between a first position wherein undercarriage 3 engages the track and a second, extended position (illustrated) wherein undercarriage 3 is retracted and undercarriage 2 supports the frame end on the track, the longer wheel base enabling the track to be lifted so that it assumes a natural flexure.

In the illustrated embodiment, forward machine frame end 6 is pivoted to frame 5 of a track working machine and power plant 10 is arranged on the rear end of the machine, which also holds central control station 11. Arrangement 12 for excavating the ballast and conveying the excavated ballast is vertically adjustably mounted on frame 9 adjacent the forward end thereof, being linked thereto in a conventional manner by hydraulic jacks which enable the arrangement to be vertically adjusted and/or pivoted. Ballast excavating and conveying arrangement 12 includes driven endless chain 29 for excavating and conveying the ballast and a polygonal guide for guiding the driven chain, the guide having a transverse section and at least one section leading from the transverse section in a longitudinal direction along frame 9.

First vibratory and vertically adjustable ballast screening installation 14 is mounted on frame 9. Vertical adjustment drive or jack 16 enables the installation to be pivoted about an axis extending in the direction of elongation of the machine and vibrating drive 18 imparts linear oscillations to the installation. The installation has an inlet to receive the conveyed ballast from an output of ballast excavating and conveying arrangement 12 and to separate the ballast into a cleaned ballast component and a waste component, as will be explained in more detail hereinafter in connection with FIG. 3. In accordance with the invention, a further ballast screening installation 13 is also mounted on the frame, like but separate drive means 17, 15 being provided for vibrating and vertically adjusting the further ballast screening installation for operation in a manner substantially identical to that of installation 14. Remote-controllable conveyor means 19 is arranged for selectively receiving the ballast from the ballast excavating and conveying arrangement output and delivering it to an inlet of further ballast screening installation 13. In the illustrated embodiment, the first and further ballast screening installations 14, 13 are arranged on frame 9 immediately adjacent each other in the direction of the elongation of the frame. This arrangement provides a particularly simple and advantageous structure because the transfer of the conveyed ballast to the further installation as well as conveyor means 23 and 20 for redistributing the cleaned ballast component and for removing the waste component require the shortest possible transport paths while keeping the conveyor means within the width of the track bed.

The conveyor means for removing the waste component comprises elongated conveyor band 20 having an input end extending below ballast screening installations 13, 14 to receive the waste component therefrom and an output end at the forward end of machine 1 whence the waste is moved to additional conveyors which transport it to freight cars (not shown) coupled to the machine. Conveyor means 23 for redistributing the cleaned ballast component comprises two sequentially arranged ballast conveyor bands 21, 22 arranged on the underside of machine frame 9 to receive the cleaned ballast from the first and further ballast screening installations. Separate and independent controls constituted by driven pulleys 35 and 36 (see FIG. 3) operate the two conveyor bands.

Such a cleaned ballast redistributing conveyor means is readily coordinated with the operation of the two ballast screening installations in dependence on the amount of ballast being excavated. When only one installation is in use, a single conveyor band may be operated. Also, since separate and independent controls 15, 17 and 16, 18 are provided for vibrating and vertically adjusting first and further ballast screening installations 14, 13, the machine may be readily adapted for handling different types and amounts of ballast with the use of one or both installations and/or with a change in the screening capacity in dependence on the intensity of the vibrations. The independent vertical adjustment enables the lateral position of these heavy installations to be readily adapted to any superelevation of the track so that accumulations of ballast on one side or the other of the installations is avoided.

Vertically adjustable ballast planing device 24 is mounted on frame 9 in the range of the forward, output end of cleaned ballast conveyor band 22 to enable the redistributed cleaned ballast to be suitably smoothed and leveled. Vertically adjustable track lifting unit 25 including rail clamping rollers is mounted on the machine frame forwardly of planing device 24, all of this structure being generally conventional.

Track lifting and tamping unit 26 is mounted on the frame of track working machine 5 to which the forward end 6 of machine frame 9 is pivoted and a suitable drive enables unit 26 to be displaced along machine frame 5 in the direction of elongation of the machine.

Hydrostatic level measuring devices 27 of the type disclosed in the above-mentioned British patent specification are mounted on the machine to provide a reference and this measuring system is of particular advantage in machine 1 which has a high capacity and, therefore, can be used at relatively high forward speeds. As schematically indicated by broken lines 28, all the drives are connected to central control station 11 for independent operation of the respective structures.

Figure 2:
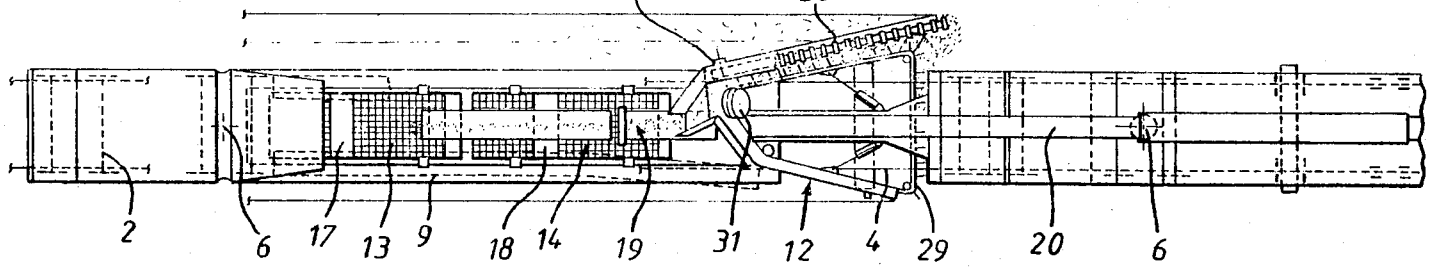
FIG. 2 is a top view of the machine of FIG. 1.

As appears particularly from FIG. 2, frame 9 is comprised of two spaced-apart carriers for the two ballast screening installations and interconnected into a unit by ballast excavating and conveying arrangement 12. FIG. 2 shows the uppermost screens of installations 13 and 14 whose mesh size is designed to retain ballast pieces of excess size. The illustrated ballast and excavating arrangement includes endless chain 29 for excavating and conveying the ballast and a polygonal guide for guiding the chain, as well as endless auxiliary chain 30, the auxiliary chain forming a unit with arrangement 12 for common vertical and pivotal adjustment. Endless excavating and conveying chain 29 is driven by hydraulic drive 31 in a first plane and endless auxiliary chain 30 is driven by hydraulic drive 32 in a second plane substantially perpendicular to the first plane. The enhanced ballast conveying capacity achieved by this embodiment enables the ballast excavating and conveying arrangement to be readily adapted to the increased cleaning capacity obtained by the two ballast screening installations, thus further improving the efficiency of the machine. The simple arrangement of the auxiliary ballast conveying machine does not interfere with the operation of the other operating structures and is very space-efficient.

Figure 3:
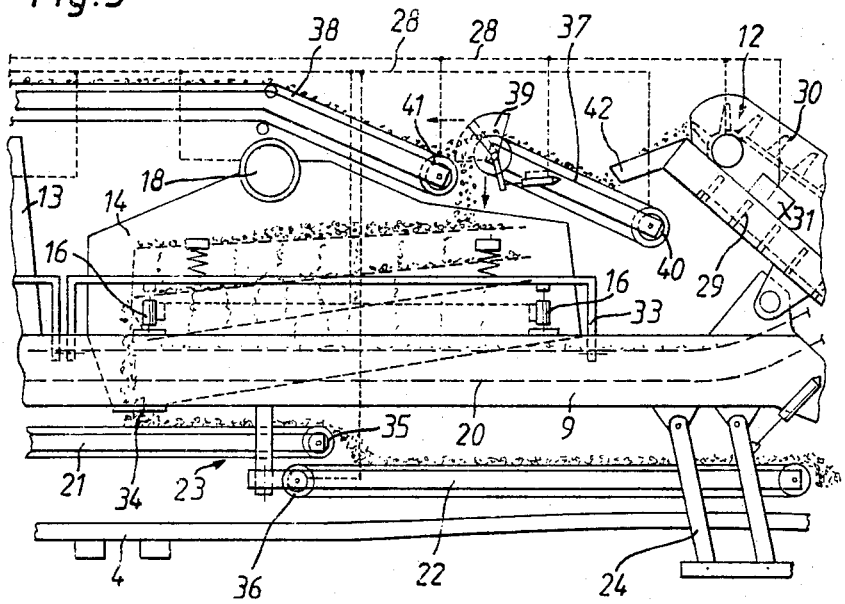
FIG. 3 is an enlarged fragmentary side elevational view of the machine in the region of the ballast screening installations.

Enlarged FIG. 3 shows first ballast screening installation 14 freely oscillatably mounted on frame 33 by means of shock-absorbing springs. This carrier frame of the installation is pivotal about an axis extending in the direction of elongation of the machine by vertical adjustment drives 16 supporting frame 33 on machine frame 9. The three superposed screens of the installation extend obliquely to the track plane, as shown in broken lines and the screens have different mesh sizes for separating the ballast into a cleaned ballast component and a waste component. The structure of the ballast screening installation is generally conventional and it includes a centered outlet opening (not visible) at the bottom of the installation for depositing the waste component on conveyor means 20 for removing the waste component. Another outlet opening 34 is arranged laterally of the waste component outlet opening for depositing the cleaned ballast on conveyor band 21 of cleaned ballast redistributing conveyor means 23 which includes forward conveyor band 22 receiving the cleaned ballast from conveyor band 21 and being mounted on frame 9 for pivoting in a plane substantially parallel to that of the track to enable the cleaned ballast to be distributed over the track bed, all as generally conventional.

Remote-controllable conveyor means 19 is arranged selectively to receive the ballast from the ballast excavating and conveying arrangement output and to deliver it to an inlet of further ballast screening installation 13, for which purpose it is comprised of first conveyor band 37 having one end arranged below the output of ballast excavating and conveying arrangement 12 and another end arranged above the inlet of first ballast screening installation 14, and another conveyor band 38 having one end arranged below the other end of first conveyor band 37 and another end arranged above the inlet of further ballast screening installation 13 (see FIG. 1). Remote-controllable ballast guiding device 39 at the other end of first conveyor band 37 selectively guides the flow direction of the conveyed ballast, as shown in FIG. 3. First conveyor band 37 is driven by driven pulley 40 and second conveyor band 38 by driven pulley 41. Chute 42 is mounted at the output of ballast excavating and conveying arrangement 12 for transferring the conveyed ballast to first conveyor band 37. This arrangement of remote-controllable conveyor means 19 assures a particularly trouble-free and rapid conveyance of the ballast to the screening installations. Since the two conveyor bands may be selectively operated, ballast may be delivered selectively to the two installations, depending on the extent of dirt in the excavated ballast and/or the amount thereof, the two installations being operated simultaneously or separately. If the two screening installations are different, the operation of the two conveyor bands may be optimally adapted to the amount and/or type of ballast excavated, which further increases the screening efficiency. For example, if the ballast contains a large amount of oversized rocks, the first installation may be used exclusively for the separation of this ballast component so that the desired cleaned ballast component is obtained more rapidly. The arrangement of ballast flow guiding device 39 between the two conveyor bands of remote-controllable conveyor means 19 provides a simple structure for selectively delivering ballast to the screening installations while maintaining a constant conveyor speed. The guiding device need only be pivoted by remote control to direct the ballast from the first to the second conveyor band or to permit it to fall therebetween into the first screening installation.

Figure 4:
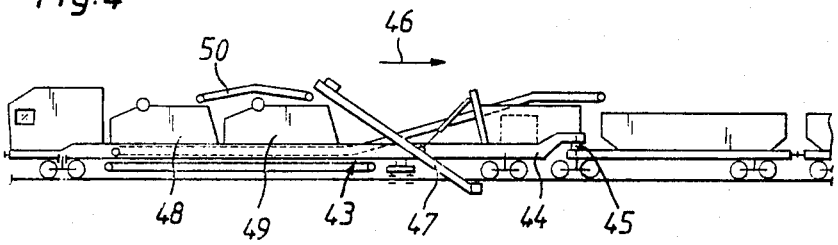
FIG. 4 is a side elevational view of another embodiment of a ballast cleaning machine.

FIG. 4 illustrates an embodiment wherein ballast cleaning machine 43 wherein two-part machine frame 44 is pivoted at 45 to a freight car receiving the waste component of the excavated ballast, the machine advancing in an operating direction indicated by arrow 46. As in the first-described embodiment, ballast excavating and conveying arrangement 47 is mounted on frame 44 to convey the excavated ballast selectively to ballast screening installations 48, 49, remote-controllable ballast conveyor means 50 being arranged for selective delivery of ballast to further screening installation 48. In this embodiment, the two ballast screening installations are of substantially the same structure.

The operation of machine 1 will partly be obvious from the above description and the sequence of operational steps will be described in some detail hereinafter. The machine has separate and independent controls 15, 17 and 16, 18 for vibrating and vertically adjusting first and further ballast screening installations 14 and 13, remote-controllable conveyor means 19 comprises first conveyor band 37 having one end arranged below the output of ballast excavating and conveying arrangement 12 and another end arranged above the inlet of the first ballast screening installation, and another conveyor band 38 having one end arranged below the other end of first conveyor band 37 and another end arranged above the inlet of the further ballast screening installation. Conveying means 23 for redistributing the cleaned ballast comprises two sequentially arranged ballast conveyor bands 21, 22 to receive the cleaned ballast from the first and further ballast screening installations. Independent controls 15, 17 and 16, 18, first conveyor band 37 and other conveyor band 38, sequentially arranged ballast conveyor bands 21, 22, and driven ballast excavating and conveying chain 29 and driven auxiliary chain 30 are all operated from central control station 11 for selectively conveying the cleaned ballast component and the waste component independently of each other. This central control for the independent operation of all operating structures produces a high economy without interrupting the forward movement of the machine or reducing its speed while adapting the operation to cleaning various amounts and/or types of ballast. For example, in a track section with a relatively shallow ballast bed, auxiliary chain 30 and further ballast screening installation 13 may be switched off by stopping drives 32 and 41 while operating guiding device 39 to direct the flow of the ballast exclusively to installation 14. This will suffice to make use of the full cleaning capacity of the machine for the smaller amount of excavated ballast without reduction of the forward speed of the machine.

In operation, machine 1 is moved on undercarriage 3 and rear undercarriages 2 to the working site. After the machine has arrived at the working site, jack 8 is actuated to lift the forward end of machine frame 9 until undercarriage 3 has been retracted from track 4 and the frame comes to rest on the track entirely on undercarriages 2, as shown in FIG. 1. As is known, the transverse section of the guide of chain 29 of ballast excavating and conveying arrangement 12 is then introduced into a previously prepared opening of the ballast bed below track 4 and this guide section is then re-connected to form a polygonal guide housing endless chain 29 for movement therein and therealong upon operation of drive 31. Before chain drives 31 and 32 for the excavating and conveying chain as well as the auxiliary chain and vibrating drives 17 and 18 are actuated from central control station 11, the level and superelevation of the sub-grade are adjusted according to requirements. The machine is now driven forwardly in the operating direction and the desired conveyor band drives are actuated. Excavating and conveying chain 29 carries wear-resistant excavator fingers to enable ballast to be continually torn out of the encrusted ballast bed and to be conveyed to chute 42 upon actuation of drive 31 as machine 1 advances in the direction of arrow 7. Any ballast jammed along the conveying path in the range of auxiliary chain 30 will be taken along by it continuously and will also be conveyed to chute 42 upon actuation of drive 32. The conveyed ballast will be deposited by chute 42 on first conveyor band 37.

When ballast flow guiding device 39 is rotated into the upper position shown in full lines in FIG. 1, it will not interfere with the ballast flow and, therefore, a portion of the ballast will be deposited in ballast screening installation 14 while another portion will be thrown onto second conveyor band 38 which conveys this ballast portion to further ballast screening installation 13. In this manner, the increased amount of ballast conveyed by endless chains 29 and 30 can be handled for cleaning without any problem. The ballast is separated in installations 13 and 14 into oversized rocks, the cleaned ballast component and waste in the two vibrating screening installations 13 and 14. The waste component is removed by conveyor means 20 while the cleaned ballast is redistributed by conveyor means 23 which throw the cleaned ballast on the prepared subgrade.

However, if further ballast screening installation 13 is not needed to make efficient use of the entire capacity of ballast excavating and conveying arrangement 12, for example in case the ballast bed is shallow and/or the ballast is relatively clean, ballast flow guiding device 39 can be rotated into the position shown in broken lines in FIG. 1 so that the entire ballast falls from first conveyor band 37 into installation 14. In this case, vibrating drive 17 and driven pulley 41 may be switched off. If the excavated ballast flows freely and does not jam along the conveying path of endless chain 29, drive 32 for auxiliary endless chain 30 may also be switched off, all these operations being remote-controlled from central control station 11. Particularly in track sections where the ballast bed is shallow, track 4 must first be lifted to enable the transverse section of ballast excavating and conveying arrangement 12 to be inserted under the track. For this purpose, longitudinally displaceable track lifting and tamping unit 26 is operated for temporarily raising track 4 and to tamp the ballast under each lifted tie. In this manner, the curvature of track 4 caused by lifting unit 25 remains within an arc of acceptable dimensions.

What is claimed is:

1. In a mobile ballast cleaning machine comprising a frame, undercarriages supporting the frame for mobility on a track resting on the ballast, an arrangement toward the forward end of the frame for excavating the ballast and for conveying the excavated ballast, the ballast excavating and conveying arrangement being vertically adjustably mounted on the frame and including a driven endless chain for excavating and conveying the ballast and a polygonal guide for guiding the driven chain, the guide having a transverse section and at least one section leading rearwardly from the transverse section in a longitudinal direction along the frame, a first vibratory and vertically adjustable ballast screening installation mounted on the frame and extending rearwardly from the excavating and conveying arrangement, and having an inlet to receive the conveyed ballast from an output of the ballast excavating and conveying arrangement and to separate the ballast into a cleaning ballast component and a waste component, and conveyor means for redistributing the cleaned ballast component and for removing the waste component; a further ballast screening installation mounted on the frame rearwardly of and adjacent the first ballast screening installation, separate drive means for vibrating and for vertically adjusting the further ballast screening installation, and a remote-controllable conveyor means arranged to receive the ballast from the ballast excavating and conveying arrangement output and to deliver it to the first ballast screening installation and upon selective adjustment of a remote-controllable portion of the remote-controllable conveyor means to also deliver ballast from the ballast excavating and conveying arrangement to an inlet of the further ballast screening installation.

2. In the ballast cleaning machine of claim 1, the conveying means for redistributing the cleaned ballast comprising two sequentially arranged ballast conveyor bands arranged to receive the cleaned ballast from the first and further ballast screening installations.

3. In the ballast cleaning machine of claim 2, separate and independent controls for operating the two conveyor bands.

4. In the ballast cleaning machine of claim 1, separate and independent controls for vibrating and vertically adjusting the first and further ballast screening installations.

5. In the ballast cleaning machine of claim 1, the remote-controllable conveyor means comprising a first conveyor band having one end arranged below the output of the ballast excavating and conveying arrangement and another end arranged above the inlet of the first ballast screening installation, and another conveyor band having one end arranged below the other end of the first conveyor band and another end arranged above the inlet of the further ballast screening installation.

6. In the ballast cleaning machine of claim 5, the remote-controllable portion comprising a remote-controllable ballast guiding device at the other end of the first conveyor band for selectively guiding the flow direction of the conveyed ballast.

7. In the ballast cleaning machine of claim 1, the frame having pivotally supported ends, and a drive for vertically adjusting the frame end adjacent the ballast excavating and conveying arrangement.

8. In the ballast cleaning machine of claim 1, the ballast excavating and conveying arrangement further including an endless auxiliary driven chain, the auxiliary chain forming a unit with the arrangement for common vertical and pivotal adjustment, the endless excavating and conveying chain being driven in a first plane and the endless auxiliary chain being driven in a second plane substantially perpendicular to the first plane.

9. In the ballast cleaning machine of claim 8, separate and independent controls for vibrating and vertically adjusting the first and further ballast screening installations, the remote-controllable conveyor means comprising a first conveyor band having one end arranged below the output of the ballast excavating and conveying arrangement and another end arranged above the inlet of the first ballast screening installation, and another conveyor band having one end arranged below the other end of the first conveyor band and another end arranged above the inlet of the further ballast screening installation, the conveying means for redistributing the cleaned ballast comprising two sequentially arranged ballast conveyor bands arranged to receive the cleaned ballast from the first and further ballast screening installations, and a central control station for operating the independent controls, the first and the other conveyor band, the sequentially arranged ballast conveyor bands, and the driven ballast excavating and conveying chain and the driven auxiliary chain for selectively conveying the cleaned ballast component and the waste component independently of each other.

* * * * *